United States Patent [19]

Jennings et al.

[11] 4,004,982

[45] Jan. 25, 1977

[54] SUPERATMOSPHERIC PRESSURE SHALE RETORTING PROCESS

[75] Inventors: Don C. Jennings; Roland O. Dhondt, both of Long Beach, Calif.

[73] Assignee: Union Oil Company of California, Los Angeles, Calif.

[22] Filed: May 5, 1976

[21] Appl. No.: 683,287

[52] U.S. Cl. ..... 201/29; 201/23; 201/27; 201/28; 201/30; 201/32; 201/34; 208/11 R

[51] Int. Cl.² ..... C10B 53/06

[58] Field of Search ..... 201/21, 23, 28, 29, 201/32, 34, 27, 30; 208/11 R

[56] References Cited

UNITED STATES PATENTS

| | | | |
|---|---|---|---|
| 2,435,746 | 2/1948 | Jones | 201/29 |
| 2,501,153 | 3/1950 | Berg | 201/29 X |
| 2,550,432 | 3/1951 | Thompson | 201/28 X |
| 2,640,019 | 5/1953 | Berg | 208/11 R UX |
| 2,895,884 | 7/1959 | Switzer | 208/11 R UX |
| 2,989,442 | 6/1961 | Dorsey | 201/29 |
| 3,004,898 | 10/1961 | Deering | 208/11 R UX |
| 3,006,816 | 10/1961 | Finney | 201/28 |
| 3,361,644 | 1/1968 | Deering | 201/29 |
| 3,483,115 | 12/1969 | Haddad et al. | 201/29 X |
| 3,634,225 | 1/1972 | Garbett | 201/29 X |
| 3,841,992 | 10/1974 | Jones et al. | 201/30 X |

*Primary Examiner*—Barry S. Richman
*Attorney, Agent, or Firm*—Lannas S. Henderson; Richard C. Hartman; Dean Sandford

[57] ABSTRACT

In a continuous, solids upflow, gas downflow shale retorting process carried out at superatmospheric pressures, hydrostatic sealing means are provided at the shale inlet and retorted shale outlet ends of the retort, thereby avoiding the need for mechanical sealing means, lock vessels, etc. The raw shale is fed into the retort through a standing reservoir of product oil, or preferably a light fraction thereof, and the retorted shale is discharged from the retort through a water quenching zone and seal, in the lower portion of which is maintained a sufficient hydrostatic head of water to prevent the discharge therethrough of retort gases. Steam generated in the quench zone, containing some entrained hydrocarbonaceous matter, is treated in a multistage cooling and condensing manner for gas cleanup and for recovery of heat and an oil-free water condensate for recycle to the water sealing and quench zones.

9 Claims, 1 Drawing Figure

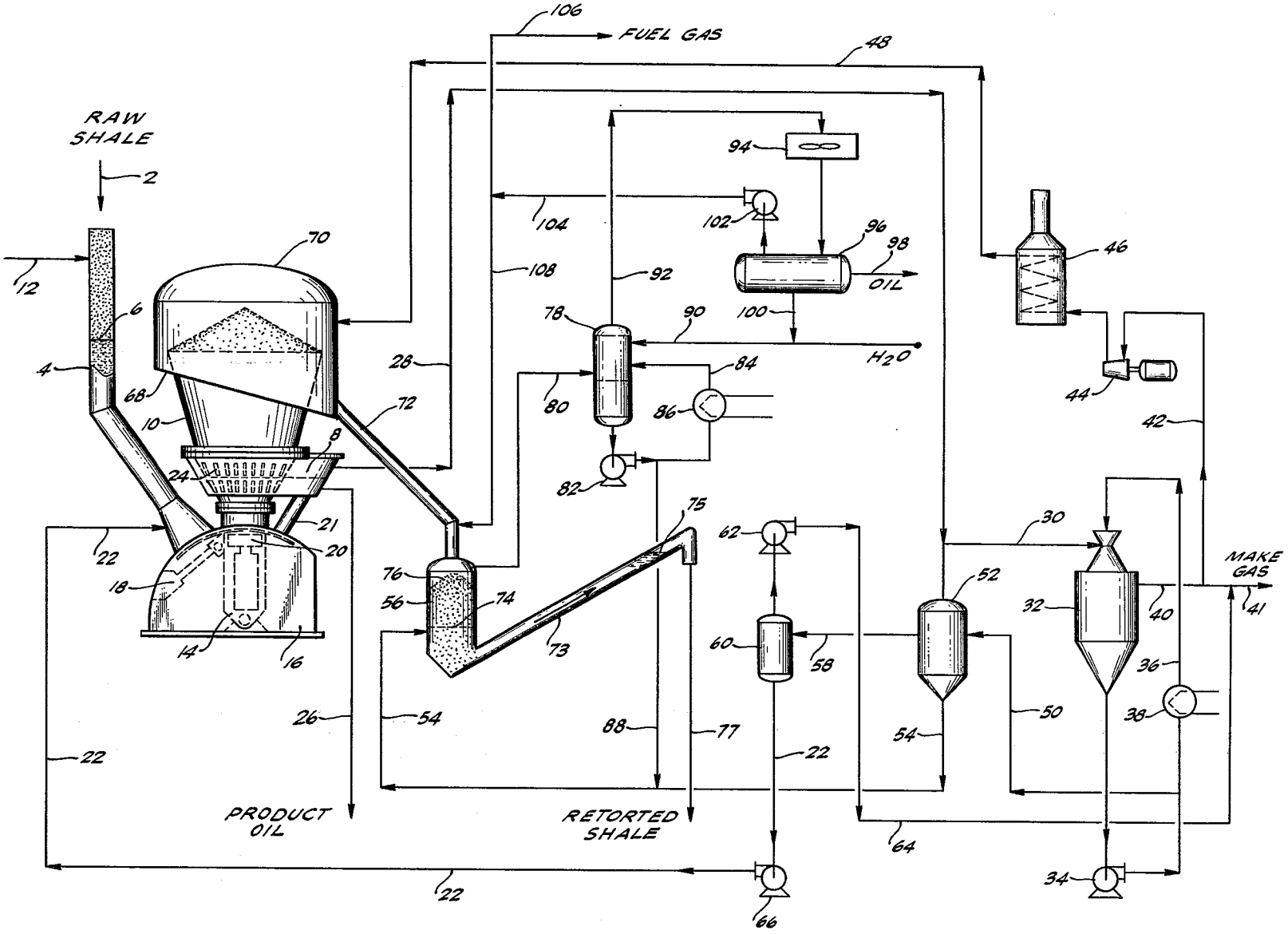
MAKE GAS
41
42
40
36
38
34
46
44
30
32
50
52
54
64
48
96
98
OIL
$H_2O$
58
22
94
100
102
62
60
66
84
90
86
77
75
92
88
RETORTED SHALE
FUEL GAS
106
104
108
78
80
82
73
74
76
56
54
22
28
72
70
8
21
20
26
PRODUCT OIL
16
14
24
10
68
18
RAW SHALE
2
6
4
12
22
22

SUPERATMOSPHERIC PRESSURE SHALE RETORTING PROCESS

BACKGROUND OF THE INVENTION

This invention relates to certain improvements in oil shale retorting involving the solids-upflow, gas-downflow retorting technique, such as that described in U.S. Pat. No. 3,361,644. In that process crushed oil shale is fed upwardly through a vertical retort by means of reciprocating feed piston. The upwardly moving shale bed continuously exchanges heat with a downflowing, high specific heat, hydrocarbonaceous recycle gas introduced into the top of the retort at about 950°–1200° F. In the upper section of the retort (the pyrolysis zone), the hot recycle gas educes hydrogen and hydrocarbonaceous vapors from the shale. In the lower sections of the retort the oil shale is preheated to pyrolysis temperature by exchanging heat with the mixture of recycle gas and educed product vapors. Most of the heavier hydrocarbons condense in the lower portion of the retort, and are continually swept away from the hot pyrolysis zone and collected at the bottom of the retort as product oil. The uncondensed gas is then passed through external condensing and/or demisting means to obtain more product oil. The remaining gases are utilized as high Btu product gas, recycle gas as above described, and as fuel gas to preheat the recycle gas up to the above specified temperatures.

Retorting in the above manner generally requires a total heat input ranging between about 350,000 and 450,000 Btu's per ton of shale. This in turn entails recycling a large mass of recycle gas to provide the necessary heat carrying capacity. Conventionally, the process has been operated at atmospheric pressures or slightly below, entailing very large volumes of recycle gas, ranging up to about 30,000 SCF/ton of raw shale. It would be highly desirable to operate the retorting system at moderately elevated pressures of e.g., 10–50 psig, whereby the volume of recycle gas would be drastically reduced, thereby providing very significant savings in recycle gas compressor facilities and utilities, as well as improving heat exchange efficiencies. However, to operate at elevated pressures, means must be provided for introducing the shale into the retort and removing retorted shale therefrom without allowing the retort gases to depressure through the granular shale being introduced into, and removed from, the retorting zone. Conventional methods for achieving this objective involve the use of expensive and elaborate lock vessels, valves, star feeders, slide valves and the like. These devices are subject to failure through rapid wearing of moving parts, and tend to produce fines through crushing or abrading of the shale.

It has been found to be entirely feasible and reiable to maintain pressure in the retorting zone by providing relatively simple hydrostatic sealing arrangements through which solids are fed into and removed from the retort. In a typical arrangement, an elongated upwardly extending feed conduit is provided, communicating at its lower end with the cylinder in which the feed pump piston reciprocates, and with the liquid reservoir of oil which collects around the bottom of the retort. Raw shale is fed into the top of the feed conduit and retort pressure is allowed to establish a level of product oil in the feed conduit which may be, e.g., 5–50 feet higher than the oil level around the bottom of the retort. The raw shale gravitates downwardly as a compact bed through the oil seal and is intermittently fed into the feed cylinder and thence pumped upwardly into the retort.

If the oil forming the hydrostatic head in the shale feed conduit consists of full range retort product oil, a problem will sometimes be encountered when operating in cold climates. Full range shale oil normally has a pour point ranging between about 70°–90° F, while the shale entering the feed conduit may be at considerably lower temperatures. Under these circumstances, the shale oil will congeal and cause plugging or bridging of the feed conduit. This difficulty could of course be overcome by providing suitable heating devices for the feed conduit, but we have devised a much simpler and more economical solution to the problem. According to a preferred procedure, a low pour point relatively light fraction of the shale oil product is continuously recycled to the shale feed conduit so as to maintain an inventory of light oil therein, filling the conduit up to the level established by the retort pressure. The light oil flows downwardly into the retort feed mechanism and mingles with retort product oil from the lower disengaging section of the retort. In this manner, high pour point oil is essentially excluded from the shale feed conduit.

After passing upwardly through the retort, retorted shale at a temperature of about 900°–1100° F overflows the top of the retort and is gravitated downwardly through a suitable conduit into the top of a water quenching zone, in which a liquid level of water is maintained which is substantially below the level of the retorted shale therein. The bottom of the quenching zone communicates with an elongated, upwardly extending sealing leg in which a water level is maintained substantially higher than the water level in the quenching zone, sufficient to prevent the passage of retort gases through the sealing leg. A suitable solids conveying mechanism in the sealing leg carries spent shale upwardly and out of the sealing leg at a rate controlled to maintain the desired solids level in the quenching zone.

By operating the quench zone with a retorted shale level above the water level therein, superheated steam is produced which contacts the hot solids, and it is found that considerable gasification of the coke and/or hydrocarbonaceous deposits on the retorted shale takes place, producing substantial amounts of hydrogen and light hydrocarbons. The mixture of superheated steam and noncondensable gases generated in the water quenching zone is removed from this zone and the steam is then partially condensed in a quench tower by countercurrent contact with a circulating stream of water admitted to the top of the tower at a temperature between about 200° and 240° F. Substantial process heat is recovered from the circulating stream of water by conventional heat exchange means.

A complication in the operation of the quench tower arises from the fact that the superheated steam admitted thereto carries along with it a small amount of heavy hydrocarbons stripped from the retorted shale. If not removed from the system, these materials tend to accumulate and eventually form an asphaltic type deposit which can cause plugging problems and reduct heat exchange efficiency. It has been found that this problem can be solved very effectively by maintaining suitable temperature control of the overhead gas stream from the quench tower, so as to maintain sufficient steam flow overhead to strip out most of the hydrocarbons. This overhead gas stream is then further cooled to temperatures of about 100°–200° F to condense out the small amount of steam and hydrocarbons contained therein. The condensate is then separated from the noncondensable gases in a small secondary separator. The resulting oil and water phases are then separated, and the uncondensed gases comprising hydrogen and light hydrocarbons can be utilized as a low Btu fuel gas.

BRIEF DESCRIPTION OF DRAWING

The attached drawing is a simplified flow diagram illustrating one preferred mode of operation of the process.

DETAILED DESCRIPTION

Any of a large number of naturally occurring oil producing shales can be used herein. The characteristics of these materials are generally well known and hence need not be described in detail. For practical purposes however, the raw shale should contain at least about 10, preferably at least 20 and usually between about 25 and 75 gallons of oil per ton of raw shale by Fischer assay. The shale should be crushed to produce a raw feed having no particles greater than 6 inches, a preferably none greater than 3 inches mean diameter. Average particle sizes of about ⅛ inch to 2 inches mean diameter are preferred. Successful retorting of such shales in the mode described herein generally requires a total heat input ranging between about 350,000 and 450,000 Btu's per ton of shale.

Referring now to the drawing, the raw shale is fed at 2 into the top of elongated feed conduit 4, and gravitates downwardly therein at a rate controlled in response to the shale feeding mechanism to be subsequently described. A liquid oil level 6 is maintained in the feed conduit by virtue of the super-atmospheric pressure prevailing in product collection tank 8 of retort 10. Preferably a small stream of inert purge gas is injected via line 12 into the top of feed conduit 4, at a point intermediate between liquid level 6 and the top of the conduit, mainly in order to blanket the oil from atmospheric oxygen.

Shale is transferred from the bottom of feed conduit 4 into the bottom of the retort by means of an oscillating piston pump 14 located in feeder housing 16. Piston pump 14 oscillates between the retort feeding position shown and a feed receiving position immediately below the outlet of feed conduit 4, by means of hydraulic operating cylinder 18. In the feed receiving position, reciprocating piston 20 is retracted in order to receive a fresh charge of shale for delivery to the retort. This feeding mechanism is more particularly described in U.S. Pat. No. 2,895,884, and forms no part of the present invention. By virtue of open conduit 21, there is substantially free hydraulic communication between product collection tank 8, feeder housing 16 and feed inlet conduit 4, as a result of which the pressure in product collection tank 8 determines oil level 6, feeder housing 16 being at all times filled with oil.

The oil in feed conduit 4 may comprise the condensed oil collected in product collection tank 8, but as previously noted, this oil generally has a very high pour point, and would congeal in cold weather causing plugging and bridging of the feed conduit. To overcome this problem, a low pour point light condensate recovered from the process as hereinafter described is preferably recycled via line 22 to the bottom portion of the feed conduit 4. This light oil then fills the feed conduit up to liquid level 6, and flows through feeder housing 16 and into product collection tank 8 where it mingles with retort condensate oil at a temperature generally between about 100°–200° F. In this manner, high pour point retort condensate oil is excluded from feed conduit 4. The oil recycled via line 22 should preferably have a pour point below about 50° F, and still more preferably below 40° F.

After being fed into the bottom of retort 10 as described, the raw shale passes upwardly therein, traversing a lower preheating zone and an upper pyrolysis zone. Temperatures in the lower portion of the retort are sufficiently low to condense product oil vapors from the superjacent pyrolysis zone. As the shale progresses upwardly through the retort its temperature is gradually increased to eduction levels by countercurrently flowing eduction gases which include a preheated recycle portion of retort make gas from line 9. Eduction gas temperatures are conventional, ranging between about 600° F and 1100° F, preferably between about 700° and 1000° F. Essentially all of the oil will have been educed from the shale by the time it reaches a temperature of about 900° F. Gas temperatures above about 1300° F in the education zone should not be exceeded since they result in excessive cracking of the product oil. Other retorting conditions include shale residence times in the pyrolysis zone in excess of about 10 minutes, usually about 30 minutes to 2 hours, sufficient to educe the maximum amount of oil at the selected retort temperatures. Shale feed rates usually exceed about 100, and are preferably about 1000 – 2000 pounds per hour per square foot of cross-sectional area in the retort. These values refer to average cross-sectional areas in the tapered retort illustrated in the drawing.

Pressures at the top of retort 10 may range between about 5 and 50, preferably between about 10 and 40 psig. Pressure drop through the bed of shale in the retort generally ranges between about 2–3 psi, and through the entire product recovery system between about 5–10 psi. In the retort, eduction gases and product oil flow downwardly into the cooler, condensing portion thereof, and thence into slotted, frusto-conical liquid-vapor disengagement zone 24, from which liquid product oil and vapors flow into product collection tank 8. Liquid product is withdrawn therefrom via line 26 at a rate controlled to maintain the desired liquid level in product collection tank 8. Vapor phase effluent is withdrawn from tank 8 via line 28 at a temperature of e.g., 100°–200° F. This vapor effluent contains light hydrocarbon gases and a mist of heavier hydrocarbons, the whole comprising usually about 20–30 percent by weight of total hydrocarbons recovered in the process.

To recover light hydrocarbons, the vapor effluent in line 28 is transferred via line 30 to venturi scrubber 32, in which a stream of circulating oil condensate is maintained via pump 34 and line 36, the stream being cooled to e.g., 100°–125° F by means of cooler 38. Scrubbed make gas is withdrawn via line 40, and a portion thereof is passed via line 42 and compressor 44 into recycle gas preheater 46. The preheated recycle gas is then passed to the retort via line 48 at a rate of between about 10 and 20 MSCF/ton of shale. Net condensate from scrubber 32 is taken off via line 50 and passed into oil-water separator 52, from which process water is taken off via line 54 and utilized as quench and seal water in quench vessel 56. Any gas generated in separator 52 is returned to scrubber 32 via line 30.

In order to use the light oil phase from separator 52 as hydraulic sealing fluid in feed conduit 4, it is desirable to remove dissolved light gases therefrom. For this purpose, the oil phase is transferred via line 58 to flash vessel 60 where it is flashed to a pressure of about 3–12 psia. Flash gases are removed overhead via compressor 62 and passed via line 64 to mingle with the net make gas in line 41. The degassed liquid phase is then passed via line 22 and pump 66 into the bottom portion of shale feed conduit 4 as previously described.

The retorted shale overflowing the top of retort 10 falls onto the inclined peripheral floor 68 of shroud 70, which is affixed in fluid tight fashion to the outer wall of the retort. The retorted shale then gravitates down floor 68 through chute 72 and into quench vessel 56, in which a water level 74 is maintained a substantial distance, at least about 3 feet, below shale bed level 76. The retorted shale from the lower portion of quench vessel 56 is conveyed upwardly through sealing leg 73 by means of a screw conveyor or drag chain conveyor, not shown, and transferred to disposal via line 77 at a rate controlled so as to maintain shale level 76 in vessel 56. A water level 75 is maintained in sealing leg 73, substantially above water level 74, as determined by retort pressure.

Steam generated in the lower portion of quench vessel 56 passes upwardly countercurrently to the downflowing hot solids, becoming superheated to temperatures of e.g., about 850° – 950° F. At these temperatures, some gasification of coke and/or hydrocarbonaceous residues on the retorted shale occurs in the upper portion of the quench vessel. Some hydrocarbonaceous residue is also stripped from the retorted shale. The resulting mixture of steam, noncondensable gases and hydrocarbonaceous matter can be allowed to pass upwardly through chute 72 to mingle with recycle gas from line 48. The resulting mixture is then the eduction gas in retort 10, and the combustible gases generated in quench vessel 56 are ultimately recovered along with the retort make-gas in line 40.

Preferably however, the gases from quench vessel 56 are treated in an alternative manner which generally provides more efficient overall recovery of heat values. In this mode, the mixed gases from vessel 56 are passed into the lower portion of quench tower 78, via line 80, and pass upwardly countercurrently to a circulating stream of water which is pumped via pump 82 and line 84 into the upper portion of quench tower 78 at a temperature of e.g., about 200° – 240° F. Process heat is recovered from the circulating stream by means of a conventional heat exchanger 86. Sufficient water condensate is continuously drawn off via lines 88 and 54 to supply makeup needs in quench vessel 56. Total makeup water from line 90 is admitted near the top of quench tower 78.

Uncondensed gases from tower 78 are taken off overhead in line 92 at a temperature correlated with the system pressure so as to insure that enough uncondensed steam will be taken off to strip out sufficient, i.e., at least about 90%, of the hydrocarbonaceous residues entering via line 80 to prevent the build up of tarry material in quench tower 78, overhead line 92 and air cooler 94. This temperature will normally be between about 200° and 260° F for pressures ranging between about 10 and 40 psig. Final condensation of water and hydrocarbons in the gas stream in line 92 takes place in air cooler 94, after which the gases and condensate are separated in separator 96. Separated oil is recovered via line 98, and water condensate is recycled via lines 100 and 90 to quench tower 78. The gas phase from separator 96, normally containing about 20–30 mole-percent hydrogen and 10–14 mole-percent $C_1$–$C_3$ hydrocarbons, can be produced as a low Btu fuel gas via blower 102 and lines 104 and 106. A portion of this make gas is diverted via line 108 and injected into retorted shale transfer chute 72 to act as a seal gas therein, separating the retort gases from the quench gases in vessel 56.

EXAMPLE

In a specific preferred operation, a retort similar to that illustrated in the drawing, and located at an elevation of 7000 feet (11.3 psia atmosphere pressure), is fed 10,000 tons/day of ⅛ –2 inches mean diameter crushed shale having a Fischer assay of 34 gallons/ton. Recycle gas preheated to 1000° F is pumped into the top of the retort at the rate of about 13,500 SCF per ton of shale. Gas temperatures and pressures maintained at various points in the process are as follows:

| Location | Temp., ° F | Pressure, psig |
|---|---|---|
| Top of retort | 1000 | 14 |
| Collection tank 8 | 137 | 10.7 |
| Make-gas in line 40 | 115 | 8 |
| Top of quench tower 78 | 240 | 10 |
| Separator 96 | 120 | 10 |
| Flash vessel 60 | 100 | −8 (3.3 psia) |

Operated in this manner, the retort produces the following principal products per ton of raw shale:

| | | |
|---|---|---|
| Retort Net Make Gas - | 725 | SCF |
| Mole % | | |
| $H_2$ | 26 | |
| CO | 6.4 | |
| $CH_4$ | 24.1 | |
| $C_2$–$C_4$ | 11.6 | |
| $H_2O$ | 7.3 | |
| Water quench zone net make gas - | 288 | SCF |
| Mole % | | |
| $H_2$ | 26.4 | |
| CO | 0.4 | |
| $CH_4$ | 8.3 | |
| $C_2$–$C_4$ | 2.4 | |
| $CO_2$ | 44.8 | |
| $H_2O$ | 14.9 | |
| Retort oil condensate - | 24.7 | gallons |
| Pour Point. ° F | 80 | |
| Gravity, ° API | 19.7 | |
| Distillation, TBP, ° F | | |
| IBP | 120 | |
| 50% | 775 | |
| 90% | 1015 | |
| 95% | 1065 | |
| Scrubber 52 light oil condensate - | 7.3 | gallons |
| Pour Point, ° F | 30 | |
| Gravity, ° API | 32.3 | |
| Distillation, TBP, ° F | | |
| IBP | 120 | |
| 50% | 450 | |
| 90% | 745 | |
| 95% | 840 | |

The following claims and their obvious equivalents are believed to define the true scope of the invention:

We claim:

1. In a shale retorting process wherein crushed oil shale is gravitated downwardly through a feed conduit into a feeder cylinder which alternately receives a charge of shale and then discharges the same upwardly by means of a reciprocating piston into the bottom of a communicating retort, and wherein the upflowing shale in said retort contacts hot, non-oxidative, downflowing education gases to educe product oil and gas from said upflowing oil shale, said oil and gas being discharged from the bottom portion of said retort into an isobaric product collection vessel in which a first liquid level of oil is maintained, and wherein hot, retorted shale overflowing the top of said retort is transferred through a gas-tight transfer conduit to a water quenching zone, the improvements which comprise:

1. maintaining substantially continuous hydraulic communication between the product oil in said collection vessel and the bottom of said feed conduit, whereby a second liquid oil level is maintained in said feed conduit;
2. maintaining a first liquid water level in said quenching zone, substantially below the top of the retorted shale bed maintained therein, whereby a quench gas mixture comprising superheated steam and combustable water gas is generated in said quenching zone;
3. removing shale from the bottom of said quenching zone through an upwardly extending outlet conduit communicating therewith below said first liquid water level, whereby a second liquid water level is maintained in said outlet conduit, the rate of removal of said retorted shale being controlled so as to maintain the top of said retorted shale bed substantially above said first liquid water level; and
4. maintaining superatmospheric pressures throughout said retort while preventing the discharge of retort gases through said feed conduit and said outlet conduit solely by means of the hydrostatic seals established by the oil in said feed conduit and by the water in said outlet conduit.

2. A process as defined in claim 1 wherein said superatmospheric pressures are within the range of about 5–50 psig.

3. A process as defined in claim 1 wherein product gas is withdrawn under pressure control from said collection vessel, treated for removal of heavy hydrocarbons, and a portion thereof is then reheated, repressured and recycled as said eduction gas.

4. A process as defined in claim 1 wherein said quench gas mixture is removed from the top of said quenching zone, condensed to recover heat and liquid water, and a portion of the remaining uncondensed gas is injected into said transfer conduit to provide a seal separating report gases from quench gases in said quenching zone.

5. A process as defined in claim 1 wherein said quench gas mixture is passed upwardly through said transfer conduit and thence downwardly through said retort, forming one portion of said eduction gases.

6. A process as defined in claim 1 wherein an inert gas injected into said feed conduit at a point above said second oil level, thereby blanketing said oil from atmospheric oxygen.

7. In a shale retorting process wherein crushed oil shale is fed upwardly through a vertical retort in countercurrent contact with hot, non-oxidative, downflowing eduction gases to educe product oil and gas from said upflowing oil shale, said oil and gas being discharged from the bottom portion of said retort, and wherein retorted shale at a temperature of about 900° – 1100° F overflows the top of said retort and is transferred through a gas-tight transfer conduit to a water quenching zone, the improvements which comprise:

1. maintaining a first liquid water level in said quenching zone substantially below the top of the retorted shale bed maintained therein, whereby a quench gas mixture comprising superheated steam and combustible water gas is generated in said quenching zone solely by means of heat derived from said retorted shale;
2. removing shale from the bottom of said quenching zone through an upwardly extending outlet conduit communicating therewith below said first water level, whereby a second liquid water level is maintained in said outlet conduit, the rate of removal of said retorted shale being controlled so as to maintain the top of said retorted shale bed substantially above said first liquid water level; and
3. preventing the discharge of retort gases and quench gases through said outlet conduit solely by means of the hydrostatic seal established by the water in said outlet conduit.

8. A process as defined in claim 7 wherein said quench gas mixture is removed from the top of said quenching zone, condensed to recover heat and liquid water, and a portion of the remaining uncondensed gas is injected into said transfer conduit to provide a seal separating retort gases from quench gases in said quenching zone.

9. A process as defined in claim 7 wherein said quench gas mixture is passed upwardly through said transfer conduit and thence downwardly through said retort, forming one portion of said eduction gases.

* * * * *